United States Patent [19]

Rudick et al.

[11] Patent Number: 4,848,418

[45] Date of Patent: Jul. 18, 1989

[54] MICROGRAVITY DISPENSER

[75] Inventors: Arthur G. Rudick, Marietta; William S. Credle, Jr., Stone Mountain, both of Ga.

[73] Assignee: The Coca-Cola Company, Atlanta, Ga.

[21] Appl. No.: 125,339

[22] Filed: Nov. 25, 1987

[51] Int. Cl.[4] ..... B65B 3/10

[52] U.S. Cl. ..... 141/5; 141/82; 141/83; 141/DIG. 1; 141/277; 141/269

[58] Field of Search ..... 141/1, 2, 5, 11, 18, 141/46, 82, 83, 250, 253, 269, 275, 276, 277, DIG. 1

[56] References Cited

U.S. PATENT DOCUMENTS

| | | | |
|---|---|---|---|
| 4,136,721 | 1/1979 | Holmqvist et al. | 141/11 |
| 4,347,695 | 9/1982 | Zobel et al. | 141/11 X |
| 4,416,194 | 11/1983 | Kemp | 141/82 X |
| 4,629,589 | 12/1986 | Gupta et al. | 222/129.1 X |
| 4,671,070 | 9/1987 | Rudick | 62/3 |
| 4,683,921 | 8/1987 | Neeser | 141/1 |
| 4,709,734 | 12/1987 | Rudick et al. | 141/2 |
| 4,738,113 | 4/1988 | Rudick | 62/3 |
| 4,752,018 | 6/1988 | Rudick et al. | 222/1 |

*Primary Examiner*—Ernest G. Cusick

*Attorney, Agent, or Firm*—Birch, Stewart, Kolasch & Birch

[57] ABSTRACT

A system and method for dispensing a carbonated pre-mix beverage in the microgravity conditions of outer space. Dispensing occurs from a large supply container which is maintained at a substantially constant pressure by a $CO_2$ source to keep the pre-mix carbonated. The $CO_2$ source also operates to raise and lower a drinking container platform into an engaging relationship with a filler head, while also operating to actuate a plunger rod when filling the drinking container with a beverage. The beverage is cooled prior to being dispensed into the drinking container by passing through an insulated cooling medium.

8 Claims, 1 Drawing Sheet

MICROGRAVITY DISPENSER

BACKGROUND OF THE INVENTION

The present invention is directed to a system and method for dispensing a pre-mix carbonated beverage in the microgravity conditions of outer space.

It is known that under zero or microgravity conditions of outer space, that beverage's cannot be dispensed from a conventional post-mix beverage dispenser into an ordinary vessel or package, and that beverage cannot be poured from a vessel directly into a consumer's mouth. They must be forced out of a supply container into smaller vessels and packages, under pressure, as well as being similarly forced directly into the mouth of the consumer or astronaut. For still beverages and water, the container filling method can be one of suction. Likewise, the astronaut can suck the liquid from a collapsible container through a straw.

Furthermore, the container utilized for dispensing a beverage must be of a collapsible volume type in order to preclude the creation of an air space or pocket within the container, the location of which cannot be controlled due to the substantially zero gravity conditions of outer space.

The method and system for filling packages of carbonated beverage pre-mix described in application Ser. No. 769,464 filed on Aug. 26, 1985 and issued on May 1, 1988 was developed for filling pre-mix or post-mix packages in outer space which may be easily operated and performed by an astronaut while in outer space.

The system and method described in that parent application Ser. No. 769,464 filed on Aug. 26, 1985 can be performed and utilized on Earth before the system is launched into outer space. However, the system thereof was designed to fill a need wherein empty packages could be refilled with pre-mix or carbonated water from a master supply tank in outer space which was easily operable by the crew of astronauts. Although the above described system was an advance in the art, it would be desirable to provide an even more sophisticated beverage dispenser for use in the microgravity conditions of outer space.

SUMMARY OF THE INVENTION

Accordingly, it is a primary object of the present invention to provide a system and method for dispensing a carbonated pre-mix beverage in the microgravity conditions of outer space.

It is another object of the present invention to provide a system and method for dispensing a carbonated pre-mix beverage which may be easily operated and performed by astronauts or the crew of a space ship in a quick, efficient manner.

The objects of the present invention are fulfilled by providing a system for dispensing a carbonated pre-mix beverage in the microgravity conditions of outer space comprising:

a container for storing carbonated pre-mix;

a carbon dioxide source connected at least to said container for maintaining said carbonated pre-mix at a predetermined carbonating level;

means for cooling said carbonated pre-mix;

a pre-mix package from which the carbonated beverage is consumed by an astronaut;

a platform for supporting said package, said platform being movable between a filling position and a non-filling position;

a filler head for filling said package with cooled carbonated pre-mix dispensed from said container, whereby said filler head engages with said pre-mix package in the filling position and said filler head is spaced apart from said pre-mix package in a non-filling position;

a flow rate control valve positioned in a carbonated pre-mix line between said means for cooling and said filler head; and means for holding said pre-mix package on said platform.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The objects of the present invention and the attendant advantages thereof will become more readily apparent with reference to the drawing, wherein.

DETAILED DESCRIPTION OF THE DRAWING

Figure 1:
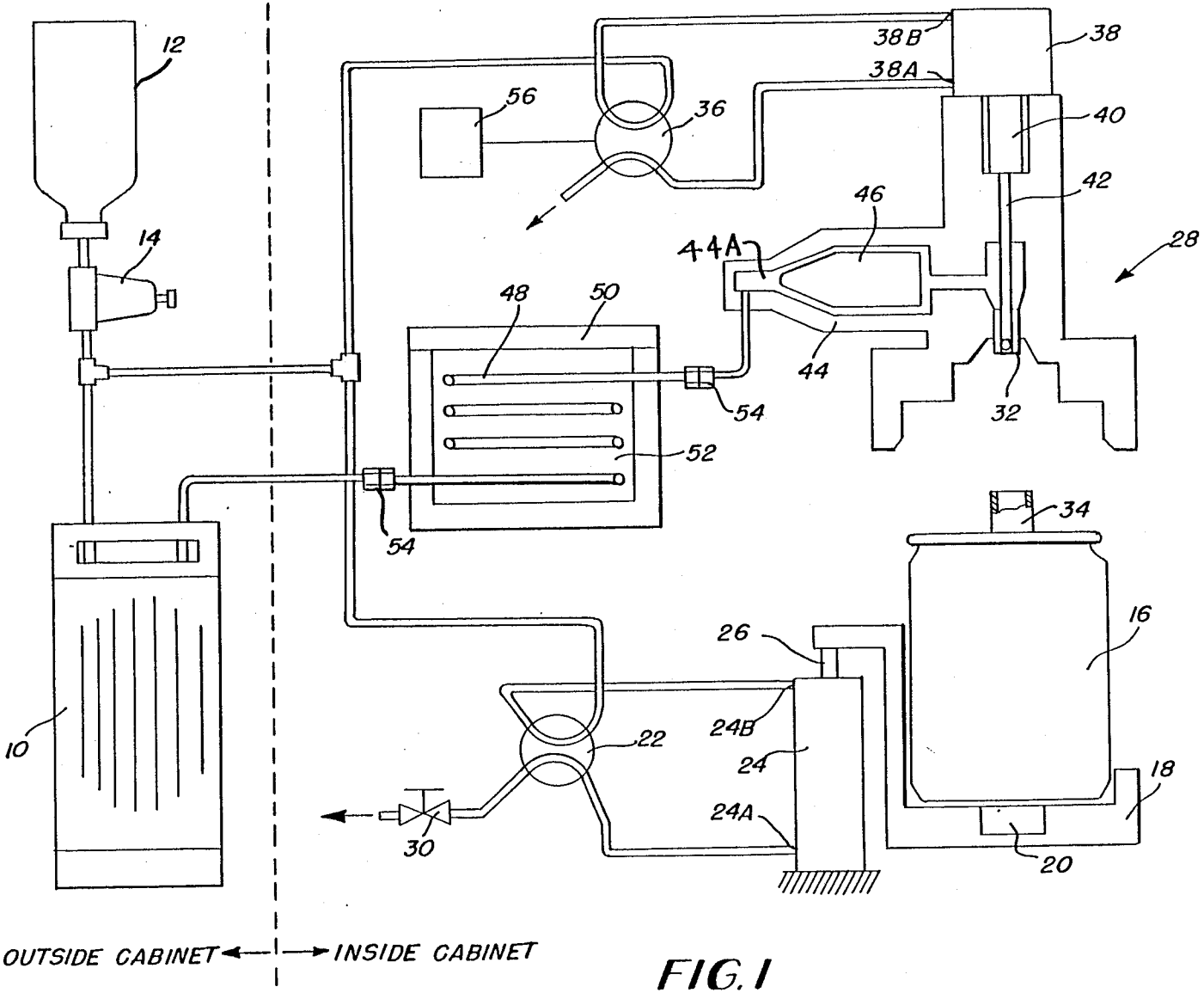
FIG. 1 is a cross-sectional schematic view in side elevation of a system for dispensing a carbonated pre-mix beverage in the microgravity conditions of outer space.

Referring to the FIGURE, which is a cross-sectional schematic view taken in side elevation, there is illustrated a system for dispensing a carbonated pre-mix beverage in the microgravity conditions of outer space.

In particular, a carbonated pre-mix is stored in a container 10 such as a conventional five gallon (hereinafter FIGAL) container modified to contain the pre-mix in a bag. Even though it is possible to pre-cool the carbonated pre-mix prior to loading the container 10 onto a space shuttle or the like, the contents thereof will be at room temperature by the time the astronauts and crew are ready to consume the carbonated beverage. Accordingly, it is most advantageous to store the container 10 at room temperature both on Earth and in outer space. An average room temperature is considered to be about 75° F.

A carbon dioxide source 12 such as a carbon dioxide cylinder, is connected to the container 10 through a regulator 14. The regulator 14 is set so as to maintain the carbonated pre-mix within the container 10 at 32 PSI. Setting of the regulator 14 at 32 PSIG ensures that the contents of container 10 stay at an optimum of 2.5 volumes of carbonation at 75° F. even in the microgravity conditions of outer space.

The carbonated pre-mix beverage is consumed by an astronaut or crew member from a smaller pre-mix package 16 which serves as a type of drinking cup in the unique conditions of outer space. This pre-mix package 16 is preferably of a recyclable modified metal can.

When an astronaut wants a refreshing pre-mix carbonated beverage, the pre-mix package 16 is placed on a platform 18. A magnet formed within the base of platform 18 ensures that the package 16 will remain in place in the microgravity conditions of outer space. The pre-mix beverage 16 is provided with a drinking spout 34, which spout 34 also serves as the package refilling conduit to be described hereinafter.

The user of the dispenser system selects a beverage by pressing a product selection button (not shown) on the cabinet face of the dispenser system. Upon product selection, a 4-way solenoid valve 22 is energized to connect the $CO_2$ source 12 to the base of a platform cylinder 24 at 24A. The lower side of the platform cylinder 24 thus receives $CO_2$ at 32 PSI while the upper side of the platform cylinder exhausts $CO_2$ gas to the exterior of the system via port 24B. Entry of $CO_2$ into the platform cylinder 24 at port 24A causes a cylinder rod 26 to extend out from the platform cylinder 24, thereby moving the platform 18 in a direction toward a filler head generally referred to at 28. By adjusting a needle valve 30 at the exhaust, the rate of cylinder speed can be controlled. At the end of a cylinder stroke, the drinking spout 34 is fully engaged with a filler tube 32 of the filler head 28. Thus, the filler tube 32 is fully inserted within the drinking tube 34 so that the package 16 is ready for filling.

A second 4-way solenoid valve 36 is positioned between the $CO_2$ source 12 and the filler head 28. When the package 16 is in an engaged relationship with the filler head 28, the solenoid valve 36 energizes to connect the lower side 38A of a cylinder 38 to the $CO_2$ source 12. The cylinder 38 is provided in connection with the filler head 28 and actuates a filler head cylinder rod 40 which in turn drives a filler head cylinder plunger 42. At the extended end of the plunger 42 is the filler tube 32 through which the carbonated beverage pre-mix must pass to enter the drinking tube 34 of the package 16. Accordingly, when the package 16 is to be filled, the $CO_2$ source 12 supplies $CO_2$ at 32 PSI to the port 38A of the filler head cylinder 38. This causes spent $CO_2$ gas to exit from the upper side of the filler head cylinder 38 at port 38B. Entry of $CO_2$ gas at port 38A causes the filler head cylinder rod 40 to retract, thereby lifting the plunger 42 out of the filler tube 32. When the filler tube 32 is free of the plunger 42, the carbonated beverage pre-mix flows into the package 16.

A flow control valve 44 having a bullet shaped piston member 46 therein is responsible for delivering the carbonated pre-mix from the FIGAL 10 to the package 16 at a controlled rate of flow at low pressure. A first side 44A of the valve 44 serves as the inlet opening for accommodating the flow of carbonated beverage pre-mix into the valve 44. The bullet shaped piston 46 is of a complementary shape to the valve 44 and is disposed within the valve housing. The piston 46 has a first cone portion and a second cylindrical portion. This unique piston shape, described more fully in application Ser. No. 769,464, filed Aug. 26, 1985, prevents any appreciable variation of flow rate and lowers the pressure of the pre-mix to ambient without any appreciable carbonation breakout or foaming. Flow rate through the flow control valve 44 is manually adjustable.

After being drawn from the FIGAL container 10 and prior to reaching the filler head 28, the carbonated pre-mix is cooled in an insulated box 50. The pre-mix is passed through cooling coils 48 which are provided within the insulated box 50. A cooling agent such as ice may be provided inside the remaining open space 52 of the insulated box 50. The passage of pre-mix through the cooling coils 48 drops the temperature of the carbonated pre-mix well below 40° F., thereby providing a cool refreshing beverage to the astronaut.

When the cold carbonated pre-mix beverage passes through the flow control valve 44, the pressure of the cold pre-mix is essentially atmospheric.

The insulated box 50 can be easily removed from the system for refilling or cleaning by disconnecting the two quick-disconnects 54.

The total amount of carbonated pre-mix beverage allowed to flow into the pre-mix package 16 is controlled by the solenoid valve 36. Specifically, the solenoid valve 36 is energized for a predetermined amount of time as regulated by a timer 56, to enable a predetermined volume of beverage to enter the pre-mix package 16. At the end of the predetermined amount of time, the solenoid valve 36 is de-energized to cause the rod 40 of the cylinder 38 to extend, thereby pushing the plunger 42 back down into the filler tube 32, stopping the flow of beverage therethrough. The solenoid valve 22 subsequently de-energizes, allowing the platform 18 to move down and disengage the drinking tube 34 from the filler head 28. The astronaut can then remove the pre-mix package 16 from the platform 18 for consumption of this selected carbonated beverage.

Also incorporated into the system of the present invention is a lock-out of the filler head solenoid valve 36, such that pre-mix flow into the package 16 will not occur if the platform 18 is in a non-filling position or if the platform 18 is in a filling position but does not have a package 16 present thereon.

Similarly, the filler head solenoid valve 36 is prevented from energizing until it is detected by the system that the platform is in a filling position and that a package is present on the platform.

It is also possible to sense the pressure of the carbonated beverage pre-mix flowing into the pre-mix package 16, and stop the flow of pre-mix if the pre-mix in the package 16 exceeds a predetermined value.

The preferred method of dispensing a carbonated pre-mix beverage in the microgravity conditions of outer space is achieved by placing a pre-mix package 16 on the platform 18. The user then pushes the appropriate product selection button located on the front of the cabinet. The 4-way solenoid valve 22 energizes to connect the lower side 24A of the cylinder 24 to the $CO_2$ source 12 at 32 PSI and simultaneously connect the upper side 24B of the cylinder 24 to the exhaust. This causes the cylinder rod 26 to extend and move the platform 18 up towards the filler head 28. By adjusting the needle valve 30, the rate of speed of cylinder 24 can be controlled. At the end of the cylinder's stroke, the package 16 should be fully engaged with the filler head 28. At this point, the filler tube 32 extends inside the drinking spout 34.

Next, a 4-way solenoid valve 36 energizes to connect the lower side 38A of the filler head cylinder 38 to the $CO_2$ source 12 at 32 PSI and simultaneously connect the upper side 38B of the filler head cylinder 38 to an exhaust. This action causes the cylinder rod 40 to retract, thereby pulling the plunger 42 out of the filler tube 32, allowing carbonated pre-mix to flow from the flow control valve 44, through the filler tube 32 and into the drinking spout 34 of the package 16, thereby filling the package for consumption.

Additionally, on its way to the filler head 28, the carbonated pre-mix first passes through cooling coils 48 within the insulated box 50 full of ice or other cooling medium. The temperature of the pre-mix thus drops well below 40° F. The cold pre-mix then passes through the flow control valve 44, dropping its pressure essentially to atmospheric for filling of the pre-mix package 16. The solenoid valve 36 is ultimately de-energized, causing the rod 40 of the filler head cylinder 38 to extend, pushing the plunger 42 back down into the filler tube 32 and shutting off the flow of pre-mix into the package 16. Finally, the solenoid valve 22 is de-energized to allow the platform 18 to move downward and away from the filler head 28. The user can then remove the package 16 for consumption of a refreshing carbonated pre-mix beverage in the microgravity conditions of outer space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for dispensing a carbonated pre-mix beverage in the microgravity conditions of outer space, comprising the steps of:

(a) storing carbonated pre-mix in a container for dispensing in outer space;

(b) connecting a carbon dioxide source to at least said container for maintaining said carbonated pre-mix at a predetermined carbonation level;

(c) cooling said carbonated pre-mix subsequent to dispensing from said container;

(d) providing a pre-mix package from which the carbonated beverage pre-mix is consumed by an astronaut;

(e) supporting said pre-mix package on a platform;

(f) moving said platform from a non-filling position to a filling position;

(g) filling said pre-mix package with cooled carbonated pre-mix dispensed from said container via a filler head, whereby said filler head engages with said pre-mix package in the filling position and is spaced apart from said pre-mix package in a non-filling position;

(h) controlling the rate of flow of said carbonated pre-mix in a flow line between said step of cooling said carbonated pre-mix and said step of filling said pre-mix package; and (i) holding said pre-mix package securely on said platform for filling purposes.

2. The method according to claim 1, further including the steps of:

(a) connecting said carbon dioxide source to a piston cylinder;

(b) lifting said pre-mix package to engage with said filler head upon said step of connecting said carbon dioxide source;

(c) disconnecting said carbon dioxide source to said piston cylinder; and (d) lowering said pre-mix package to disengage from said filler head upon said step of disconnecting said carbon dioxide source.

3. A system for dispensing a carbonated pre-mix beverage in the microgravity conditions of outer space comprising:

a container for storing carbonated pre-mix;

a carbon dioxide source connected at least to said container for maintaining said carbonated pre-mix at a predetermined carbonation level;

means for cooling said carbonated pre-mix;

a pre-mix package from which the carbonated beverage pre-mix is consumed by an astronaut;

a platform for supporting said package, said platform being movable between a filling position and a non-filling position;

a filler head for filling said package with cooled carbonated pre-mix dispensed from said container, whereby said filler head engages with said pre-mix package in the filling position and said filler head is spaced apart from said pre-mix package in a non-filling position said pre-mix package being cooled prior to exciting said filler head.

a flow rate control valve positioned in a carbonated pre-mix line between said means for cooling and said filler head; and means for holding said pre-mix package on said platform.

4. The system according to claim 3, wherein said carbon dioxide source is additionally connected to a piston cylinder for lifting said pre-mix package to engage with said filler head upon energization of said piston cylinder and for lowering said pre-mix package to disengage from said filler head upon de-energization of said piston cylinder.

5. The system according to claim 4, further including first 4-way solenoid valve positioned between said carbon dioxide source and said piston cylinder for energizing the lower side of said piston cylinder and enabling exhaust to exit from the upper side of said piston cylinder, whereby said platform is raised to a position which enables a connection between said pre-mix package and said filler head.

6. The system according to claim 4, further including a second 4-way solenoid valve positioned between said carbon dioxide source and said filler head for connecting a lower side of a filler head cylinder to the carbon dioxide source and for exhausting carbon dioxide from an upper end of the filler head cylinder, whereby pre-mix flows from said flow rate control valve through a filler tube into the drinking spout of said container for filling purposes.

7. The system according to claim 3, wherein said means for cooling said carbonated pre-mix is an insulated box containing ice and having cooling coils passing therethrough, said insulated box being positioned between said container and said flow rate control valve.

8. The system according to claim 3, wherein said means for holding said pre-mix package on said platform is a magnet positioned at the base of said platform.

* * * * *